343 - 700 MS

United States Patent [19]

Nester

[11] Patent Number: 4,500,887

[45] Date of Patent: Feb. 19, 1985

[54] MICROSTRIP NOTCH ANTENNA

[75] Inventor: William H. Nester, Liverpool, N.Y.

[73] Assignee: General Electric Company, Syracuse, N.Y.

[21] Appl. No.: 428,762

[22] Filed: Sep. 30, 1982

[51] Int. Cl.[3] ..... H01Q 1/38

[52] U.S. Cl. ..... 343/700 MS; 343/795

[58] Field of Search ..... 343/700 MS, 829, 767, 343/785, 786, 705, 708, 845, 795

[56] References Cited

U.S. PATENT DOCUMENTS

| | | | |
|---|---|---|---|
| 2,691,731 | 10/1954 | Miller | 343/786 |
| 2,895,134 | 7/1959 | Sichak | 343/786 |
| 3,836,976 | 9/1974 | Monser et al. | 343/795 |
| 4,298,878 | 11/1981 | Dupressoir et al. | 343/772 |
| 4,353,072 | 10/1982 | Monser | 343/786 |

OTHER PUBLICATIONS

Lewis, L. R., et al., "A Broadband Stripline Array Element", 1974 *International IEEE/AP-S Symposium Digest*, Georgia Institute of Technology, Jun. 1974, pp. 335–337.

Gupta, K. C., et al. *Microstrip Lines and Slotlines*, Copyright 1979, Artech House, Inc., Dedham, Mass., pp. 234–244.

Howes, Michael J., "European Microwave Conference Returns to England", *Microwave Systems News*, Aug. 1979, pp. 39–50.

Prasad et al., "A Noval MIC Slot-Line Antenna", Preceedings of the 9th European Microwave Conference, Microwave 79, Brighton, England (17–20 Sep. 1979), pp. 120–124.

*Primary Examiner*—E. Lieberman
*Assistant Examiner*—Michael C. Wimer
*Attorney, Agent, or Firm*—Richard V. Lang; Carl W. Baker

[57] ABSTRACT

A broadband radiating element design is disclosed which provides a smooth, continuous transition from a microstrip feed configuration to a flared notch antenna for transmitting or receiving radio frequency signals.

8 Claims, 8 Drawing Figures

MICROSTRIP NOTCH ANTENNA

BACKGROUND OF THE INVENTION

1. Field of the Invention

This invention relates to antenna structure, and, more particularly, to an antenna structure having a microstrip feed line and a smooth transition from the microstrip transmission line into a two-sided notch antenna.

2. Description of the Prior Art

In radio frequency antenna design, the objective is to provide a design which is compatible with feed networks and can be manufactured using low cost batch fabrication techniques, and at the same time provide broadband performance for impedance match and for pattern characteristics. As shown in FIG. 1, a conventional notch antenna 10 consists of a single-sided metallization 12 on a dielectric substrate 14 having the form of a flared slot. This conventional antenna 10 includes a transition from a microstrip feed line 16 to the notch antenna slot line 22, which requires slot line open circuit 20 which can only be realized in approximate form and which therefore limits the bandwidth capability of the circuit. In addition, the transition requires a through short circuit 18 in microstrip which for ceramic substrates or for millimeter wave designs can preclude low cost batch fabrication and/or may require approximate realizations which limit bandwidth performance.

Another prior art notch antenna construction is shown in U.S. Pat. No. 3,836,976 issued Sept. 17, 1974 to Monser et al and assigned to Raytheon Company. The patent disclosure includes a conventional single-sided notch antenna having a narrow region and a wide region with the transition being made in a single step. The disclosure describes a coaxial feed line which is soldered to the metallization layer, and again the transition from the feed line to the antenna creates a discontinuity which limits the bandwidth of the antenna structure.

SUMMARY OF THE INVENTION

An object of the present invention is to provide an antenna element configuration which is compatible with broadband applications, microstrip circuitry and low-cost batch fabrication.

A more specific object of the present invention is to provide a flared notch antenna element construction having a metallization pattern compatible with a microstrip feed line.

Accordingly, the present invention describes a structure for an antenna radiating element having a two-sided metallization pattern formed such that a smooth transition is formed from a microstrip feed to a two-sided slot line and to a two-sided flared notch antenna.

BRIEF DESCRIPTION OF THE DRAWINGS

The features of the invention believed to be novel and unobvious over the prior art are set forth with particularity in the appended claims. The invention itself, however, as to organization, method of operation and best mode contemplated by the inventor may best be understood by reference to the following description taken in conjunction with the accompanying drawings, in which like reference characters refer to like elements throughout, and in which:

DESCRIPTION OF THE PREFERRED EMBODIMENTS

Figure 2:
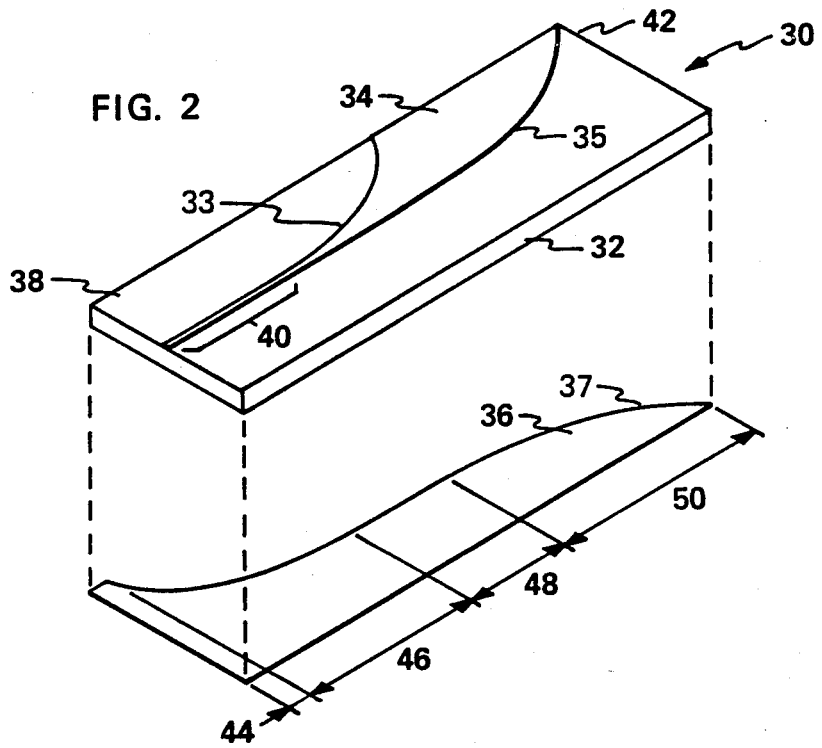
FIG. 2 is a schematic exploded view of a notch antenna element according to the present invention.

A notch antenna element of the present invention is illustrated schematically in FIG. 2. The element 30 includes a planar substrate 32, of alumina or other microwave dielectric material, having a topside metallization 34 and a bottomside metallization 36, both metallizations of, for example, copper. At the end 38 of the element 30 the element is connected to a microstrip transmission line (not shown). Metallization 34 is shaped as a narrow strip 40 near the end 38 of the substrate 32 and then transitions gradually into a broad strip covering approximately half the width of the substrate. The bottomside metallization begins at end 38 as a metallization covering the entire bottom surface of the substrate 32. It then extends in a continuous curve toward the opposite end 42 of the substrate 32 as shown. The edges 33 and 35 of topside metallization 34 and edge 37 of bottomside metallization 36 are shaped according to a function selected to provide a smooth transition from the connection to a microstrip feed line to a symmetrical two-sided flared notch antenna. In region 44 the two metallizations have the configuration of a microstrip transmission line. Region 46 is a transition region from a microstrip to a slot line configuration in which the bottomside metallization transitions to a width of approximately half the width of the dielectric substrate and topside metallization extends longitudinally along the substrate with an approximately uniform width. The top side and bottom side metallizations 34 and 36 form a two-sided slot line configuration in region 48, and a two-sided notch antenna in region 50.

A typical antenna design on 0.6"×2.0"×0.010" alumina substrate for operation over an 8.0 to 18.0 GHz frequency band uses the following metallization contours for the realization depicted in FIG. 2:

For curve 35 in region 50

$$y=0.3(x-1)^4;\ x\geqq 1.0 \tag{1}$$

where y=transverse coordinate in inches measured from the center line,

X=longitudinal coordinate in inches measured from end 38.

For curve 33 in regions 48 and 50

$$y=0.01+0.3(x-0.4)^4;\ x\geqq 0.4 \tag{2}$$

For curve 37 in region 50

$$y=-0.3(x-1)^4;\ x\geqq 1.0 \tag{3}$$

For curve 37 in regions 46 and 48

$$y=0.3(1.0-x)^4;\ x\leqq 1.0 \quad (4)$$

Figure 3:
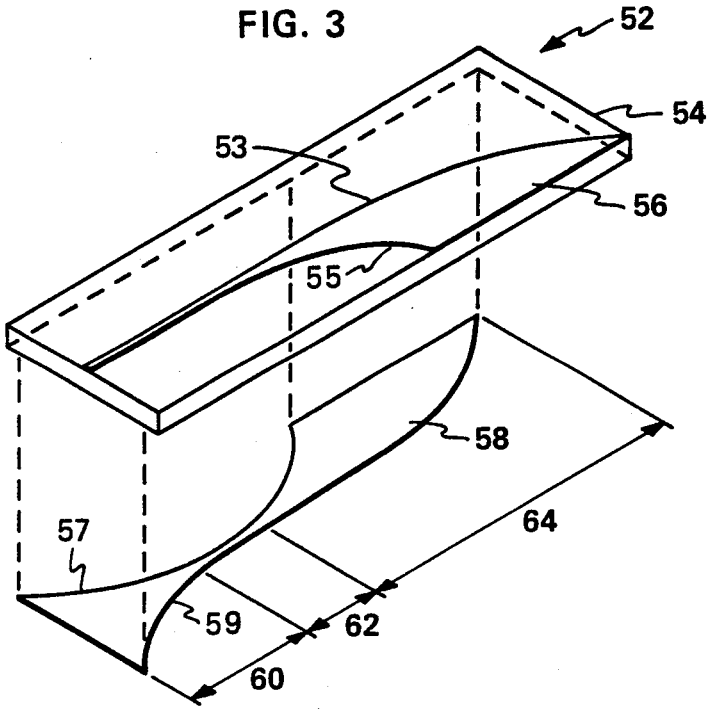
FIG. 3 is a schematic exploded view of an alternative embodiment of the notch antenna element of the present invention.

FIG. 3 illustrates an alternative embodiment of a radiating element of the present invention. Radiating element 52 includes a dielectric substrate 54, an upper metallization 56 and a bottomside metallization 58. The topside metallization 56 has a shape similar to that of metallization 34 in the embodiment of FIG. 2. The bottomside metallization 58 is shaped such that edges 57, 59 in the transition region 60 taper gradually from the full width of the substrate 54 to approximately the width of the topside metallization 56 to form a balanced transmission line region 62 from which the bottomside metallization extends into a tapering configuration similar to that of the topside metallization 56 but extending toward the opposite edge of the substrate to form the two-sided flared notch antenna region 64. As in the embodiment of FIG. 2 the contours of edges 53, 55, 57 and 59 are determined by a function selected according to desired functional characteristics.

Figure 4:
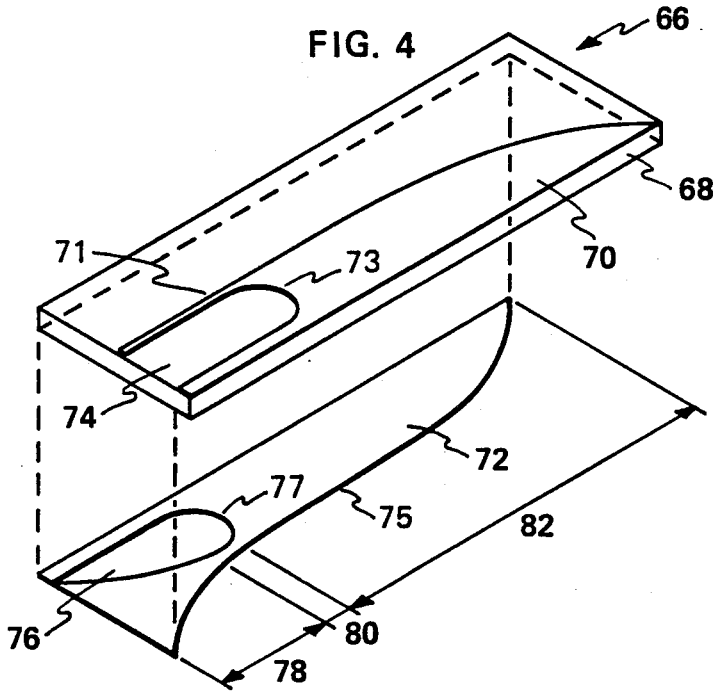
FIG. 4 is a schematic exploded view of another alternative embodiment of the notch antenna element of the present invention.

FIG. 4 illustrates another alternative embodiment of the present invention. The radiating element 66 includes a substrate 68, a topside metallization 70 and a bottomside metallization 72. Topside metallization 70 has an opening 74 at the microstrip connection end of the element to make a smooth transition from a microbalanced transmission feed line to a strip line section. Bottomside metallization 72 has an opening 76 therein to form a symmetrical transition region 78 from a microstrip feed to a balanced transmission line region 80. The topside and bottomside metallizations are then flared out smoothly into a notch antenna configuration without any discontinuities which would limit the bandwidth of the radiating element. The contours of edges 71 and 73 of topside metallization 70 and edges 75 and 77 of bottomside metallization are determined by a function as described above. As will be appreciated by those skilled in the art, other configurations which accomplish the objective of a transition from a microstrip feed line to a slot line region and to a flared notch antenna can be constructed by selecting the function for each edge of the metallizations. In each case, the bandwidth of the radiating element is not limited by any geometric discontinuities such as slot line open circuits, or through short circuits connecting the feed to the radiating element.

The curves 53, 55, 57, 58, and 59 in FIG. 3 and curves 71 and 75 in FIG. 4 can be represented by the basic equation $$(y-y_o)=0.3(x-x_o)^4 \quad (5)$$

in which $y_o$ and $x_o$ represent initial values.

Curves 73 and 77 in FIG. 4 are not critical in form or dimension and are empirically optimized for broadband pattern and impedance operation. As will be appreciated by those skilled in the art, other mathematical expressions may be used to determine metallization shape. For example power functions such as $y=y_o+(ax)^m$ for $1<m<4$, or exponential functions, such as $y=y_o+(ce^{bx})$ in which y is the transverse coordinate measured from the longitudinal centerline of the substrate, $y_o$ is an initial value, x is the longitudinal coordinate measured from the feed end of the substrate, and a, b and c arbitrary selected coefficients, can be used to generate the shapes of the contoured edges of the metallizations.

Figure 5:
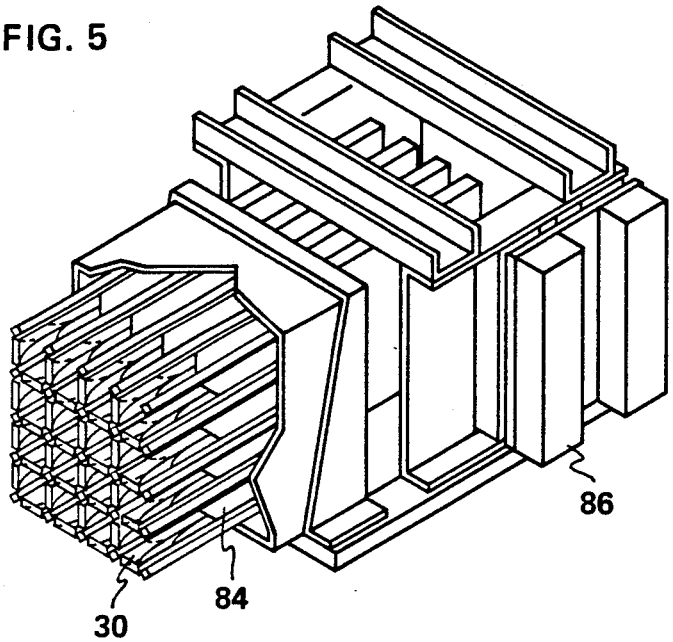
FIG. 5 is a schematic diagram illustrating an array antenna employing the notch antenna element of the present invention.

An array antenna employing the radiating elements of the present invention is illustrated schematically in FIG. 5. A plurality of radiating elements 30 are mounted in orthogonal configuration and connected to microstrip phase shifters 84 which supply a signal to the radiating elements 30. Two interleaved orthogonally polarized sets of radiating elements are illustrated. The frame 86 contains the mechanical support and electrical connections necessary to excite and control the antenna.

Figure 6A:
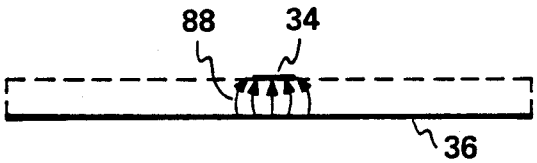
FIG. 6 is a diagram illustrating the electric field patterns in separate regions of the notch antenna element of the present invention.
Figure 6B:
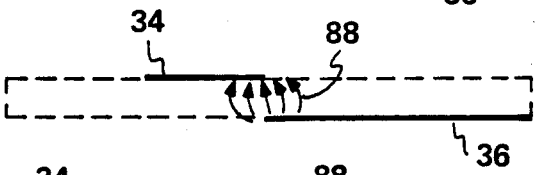
Figure 6C:
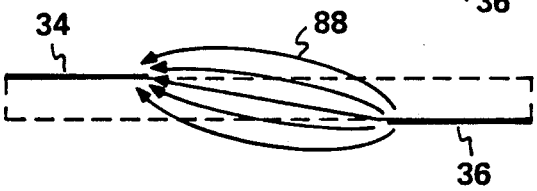

FIG. 6 illustrates the electric field geometry for the radiating element illustrated in FIG. 2. In the microstrip region 44 the electric field lines 88 extend from metallization 34 in a symmetrical pattern as shown in FIG. 6A. In the slot line region 48 in which the metallizations 34 and 36 overlap slightly, field lines 88 extend from the metallization 36 to the metallization 34 retaining the symmetrical field. but changing in shape and orientation as shown in FIG. 6B. In the notch antenna region 50 field lines 88 extend from the metallization 36 to the metallization 34 and yet another symmetrical pattern. The electric field transitions smoothly form the shape and orientation shown in FIG. 6A to that shown in FIG. 6C with no discontinuities, due to the fact that the metallization patterns contain no geometric discontinuities. Therefore, the maximum bandwidth and minimum VSWR can be achieved with radiating element patterns as shown in the present invention. For the metallization geometries shown in FIGS. 3 and 4, the electric field achieves the transitions smoothly, so that for each case the radiating element exhibits maximum bandwidth and minimum VSWR. As will be appreciated by those skilled in the art, other metallization geometries following contours determined by other continuous functions can be used to shape the transition from microstrip feed to two-sided flared notch antenna, so long as smooth, continuous transitions are achieved.

Figure 1:
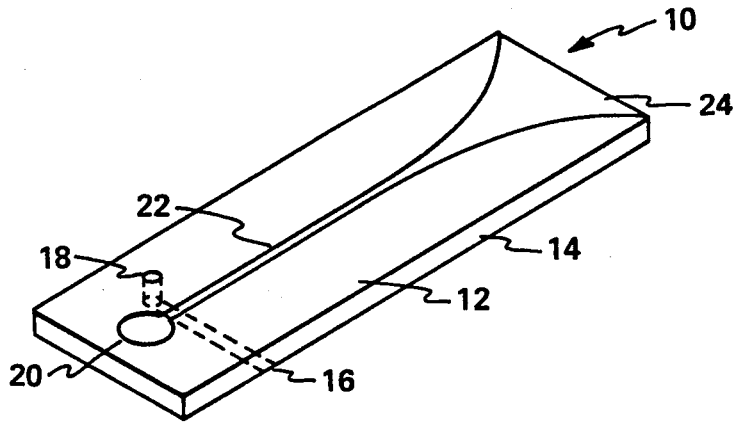
FIG. 1 (PRIOR ART)
FIG. 1 is a schematic illustration of a prior art notch antenna element.

The antenna design of the present invention accomplishes a broadband transition directly from a microstrip feed configuration to the notch antenna without the band limiting slot line open circuits or the disadvantageous microstrip through short circuits required in the conventional notch antenna as shown in FIG. 1. In the present invention a microstrip input transmission line can supply input signals to the antenna with continuous electric field transitions which do not limit the bandwidth capability of the radiating element. In the embodiments of FIGS. 2, 3 and 4 the input microstrip transmission line is coupled directly to the microstrip region of the radiating element. The top side and bottom side metallizations transition smoothly with an optional balanced transmission line as in FIGS. 3 and 4 to approximate a two-sided slot line configuration, where the slot dimension is approximately the thickness of the dielectric substrate. The metallizations then flare from a two-sided slot line configuration into a two-sided notch antenna. The broadband impedance match of the element depends upon the length and shape of the transition contours from the input microstrip to the two-sided slot line as well as the length and contour of the notch flare itself. Impedance levels are set by the dimensions of the microstrip circuit width, the thickness of the dielectric substrate and the permittivity of the substrate. The broadband radiation pattern characteristics of the radiating element depend upon the length of the notch element, the contour of the notch flare, the permittivity of the substrate and the width of the flare aperture. The width of the flare is typically between one-fourth and one-half of the free space wavelength at the lowest frequency of operation. The depth of the metallization behind the flare must be on the order of a half wavelength or more. In a test of the design of the element of FIG. 2, a bandwidth in excess of 2:1 having VSWRs less than 2:1 was achieved. Therefore, as described above, the element of the present invention provides broadband performance both for impedance match and for radiation pattern characteristics. The element may be used as a single radiating element, as a feed element in a feed system for reflector antenna, or as an array element in a phased array application. Any of the element configurations shown and described herein can be used in an orthogonally polarized interleaved array.

The present invention provides a new notch antenna design, which eliminates geometric discontinuities from the metallization patterns to be compatible with broadband applications, microstrip circuitry and low cost batch fabrication.

I claim:

1. A notch antenna comprising:

a planar dielectric substrate; and a two-sided metallization comprising a first metallization layer disposed on one major surface of said substrate;

a second metallization layer disposed on the major surface of said substrate opposite said first major surface; and said first and second metallizations being configured to form a two-sided microstrip region at one end of said substrate, a two-sided flared notch antenna region at the opposite end of said substrate, and a continuously two-sided transmission line in a longitudinally center region interconnecting said regions, the longitudinal edges of said first and second metallization layers transitioning smoothly from said microstrip region to said two-sided, flared notch antenna region.

2. The invention of claim 1 wherein:

said first metallization layer comprises a longitudinally contoured strip of metal having a narrow width at said one end of said substrate disposed generally centrally of said substrate and extending generally longitudinally along said substrate; the width of said first metallization layer increasing in the longitudinal direction to said notch antenna region; and one generally longitudinal edge of said first metallization layer extends in a generally longitudinal direction through said microstrip region and said center region to a smooth arc defined by a continuous function extending to the opposite end of said substrate, so that said one edge of said first metallization layer intersects a corner of said substrate and the other edge of said first metallization layer extends generally longitudinally through said microstrip region and extends in a smooth arc to an edge of said substrate in said notch antenna region; and said second metallization layer comprises a longitudinally contoured strip of metal extending over the full width of said substrate at said one end of said substrate opposite said narrow width portion of said first metallization layer to form said microstrip region; one longitudinal edge of said second metallization layer being defined by a function such that the width of said second metallization layer continuously narrows in the longitudinal direction to form in said center region a transition region and a slot line region connecting said microstrip region to said two-sided flared notch antenna region; said slot line region being adjacent said two-sided flared notch antenna region.

3. The invention of claim 2 wherein:

said one edge of said first metallization layer is a straight edge in said microstrip transition and slot line regions and is defined by the equation $$y=0.3(x-1)^4$$

with $x \geqq 1.0$ in said flared notch antenna region; and said other edge of said first metallization layer is a straight line in said microstrip and transition regions and is defined by the equation $$y=0.01+0.3(x-0.4)^4$$

with $x \geqq 0.4$ in said slot line and said notch antenna regions; and said one edge of said second metallization layer extends along the edge of said substrate through said microstrip region, is defined by the equation $$y=0.3(1.0-x)^4$$

with $x \leqq 1.0$ in said transition and said slot line regions, and is defined by the equation $$y=-0.3(x-1)^4$$

with $x \geqq 1.0$ in said two-sided flared notch antenna region.

4. The invention of claim 1 wherein:

said first metallization layer comprises a longitudinally contoured strip of metal having a narrow width at said one end of said substrate disposed generally centrally of said substrate and extending generally longitudinally along said substrate; one edge of said first metallization layer extends in a generally longitudinal direction through said microstrip region and said center region to a smooth arc defined by a continuous function extending to the opposite end of said substrate, so that said one edge of said first metallization layer intersects a corner of said substrate; and the other edge of said first metallization layer extends generally longitudinally through said microstrip region and extends in a smooth arc to an edge of said substrate in said notch antenna region; and said second metallization layer comprises a longitudinally contoured strip of metal extending over the full width of said substrate at said one end of said substrate opposite said narrow width portion of said first metallization layer to form said microstrip region; each longitudinal edge of said second metallization layer being defined by a continuous function to form a layer symmetrical about the longitudinal axis of said substrate in said microstrip region and narrowing continuously in said center region to form a transition region and a balanced transmission line region connecting said microstrip region to said notch antenna region; said longitudinal edges of said second metallization being contoured to form said balanced transmission line region adjacent said notch antenna region; and said longitudinal edges of said second metallization layer being contoured to form a mirror image of said first metallization layer to form said two-sided, flared notch antenna region longitudinally adjacent said balanced transmission line region.

5. The invention of claim 1 wherein:

said first metallization layer comprises a longitudinally contoured strip of metal having a first narrow width member at said one end of said substrate disposed at approximately the lateral center of said substrate and a second narrow width member at one lateral edge of said substrate at said one end of said substrate; the respective facing edges of each of said first and second members being formed by an arch cut from said first metallization layer; the outer longitudinal edge of said first narrow width member extending the full length of said first metallization layer and extending generally longitudinally through said microstrip and center regions and having a contour defined by a continuous function so that said outer edge of said first narrow width member extends to a corner of said substrate; and said second metallization layer comprises a longitudinally contoured strip of metal extending over a substantial majority of the width of the substrate at said one end of said substrate and having a first edge defined by a continuous function to define a continuously decreasing width metallization extending from said one end of said substrate to the opposite end; said second metallization layer having a second edge defined by an edge shaped to form a narrow width member on the lateral edge of said substrate opposite said one lateral edge and a symmetrically continuously narrowing member at the lateral center of said substrate so that said outer edge of said first metallization layer and said first edge of said second metallization layer form a transition to a balanced transmission line and a slot line in said longitudinally center region; and said two-sided, flared notch antenna region at said opposite end of said substrate.

6. The notch antenna set forth in claim 1 wherein:

the longitudinal edges of said first and second metallization layers are shaped in said longitudinally center region to form successively a microstrip to slot line transition and a slot line, transitioning to said notch antenna.

7. The notch antenna set forth in claim 1 wherein:

the longitudinal edges of said first and second metallization layers are shaped in said longitudinally center region to form successively a microstrip to balanced transmission line transition, a balanced transmission line, transitioning to a slot line, and a slot line transitioning to said notch antenna.

8. The notch antenna set forth in claim 7 wherein:

said first and second metallization layers have openings separating the laterally center transmission line from the laterally outer edges of said two-sided flared notch antenna at the transition from microstrip to balanced transmission line, said laterally outer edges being substantially linear and extending substantially the length of said substrate.

* * * * *